US010150654B2

(12) United States Patent
Vikman et al.

(10) Patent No.: US 10,150,654 B2
(45) Date of Patent: Dec. 11, 2018

(54) MANAGING ACCESS RIGHTS TO A CRANE

(71) Applicant: KONECRANES GLOBAL CORPORATION, Hyvinkää (FI)

(72) Inventors: Timo Vikman, Hämeenlinna (FI); Tuomas Martinkallio, Hyvinkää (FI); Matti Kemppainen, Hyvinkää (FI); Lasse Härkönen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 14/913,657

(22) PCT Filed: Aug. 22, 2014

(86) PCT No.: PCT/FI2014/050644
§ 371 (c)(1),
(2) Date: Feb. 22, 2016

(87) PCT Pub. No.: WO2015/025086
PCT Pub. Date: Feb. 26, 2015

(65) Prior Publication Data

US 2016/0207743 A1 Jul. 21, 2016

(30) Foreign Application Priority Data

Aug. 23, 2013 (FI) ..... 20135855

(51) Int. Cl.
*B66C 13/18* (2006.01)
*B66C 15/00* (2006.01)
*B66C 13/40* (2006.01)

(52) U.S. Cl.
CPC ..... *B66C 13/18* (2013.01); *B66C 13/40* (2013.01); *B66C 15/00* (2013.01)

(58) Field of Classification Search
CPC ..... B66C 13/18; B66C 15/00
See application file for complete search history.

(56) References Cited

U.S. PATENT DOCUMENTS

2002/0037211 A1* 3/2002 Korycan ..... B60P 1/167 414/501
2003/0197592 A1* 10/2003 Mokler ..... E02F 9/2004 340/5.31

(Continued)

FOREIGN PATENT DOCUMENTS

CN 101310234 A 11/2008
CN 10139172 A 3/2009

(Continued)

OTHER PUBLICATIONS

Lu et al., "Scenarios for applying RFID technology in construction project management", Elsevier, Automation in Construction, 2011, vol. 20, pp. 101-106.

*Primary Examiner* — Redhwan K Mawari
*Assistant Examiner* — Rodney P King
(74) *Attorney, Agent, or Firm* — Birch, Stewart, Kolasch & Birch, LLP

(57) ABSTRACT

A system is provided for identifying an operator and managing access rights in connection with a crane. The crane includes a control system and a controller positioned at a distance from it. The control system maintains a plurality of operator-specific parameters that define operator rights. An identifier reader is placed in connection with the controller for reading the operator's identifier by using a first connection. A second connection is set up between the identifier reader and the control system to send the operator's identifier, or information derived from it, to the control system. The control system compares the operations requested through the controller with the operator-specific parameters, which define operator rights, and allows the operation of the crane only within the scope of rights associated with the operator's identifier.

11 Claims, 3 Drawing Sheets

(56) References Cited

U.S. PATENT DOCUMENTS

| | | | | |
|---|---|---|---|---|
| 2008/0033588 | A1 | 2/2008 | Kubo et al. | |
| 2010/0039319 | A1 | 2/2010 | Cameron | |
| 2010/0127824 | A1 | 5/2010 | Möschl et al. | |
| 2011/0276261 | A1* | 11/2011 | Mizutani | B66C 13/18 701/123 |
| 2012/0041638 | A1* | 2/2012 | Johnson | G07C 5/008 701/33.1 |
| 2014/0116975 | A1* | 5/2014 | Benton | B66C 23/88 212/302 |

FOREIGN PATENT DOCUMENTS

| | | | |
|---|---|---|---|
| CN | 102205928 | A | 10/2011 |
| DE | 10 2009 051 819 | A1 | 6/2010 |
| EP | 2 458 463 | A1 | 5/2012 |
| GB | 2484468 | A | 4/2012 |
| KR | 10-2011-0057332 | A | 6/2011 |
| KR | 10-2013-0031609 | A | 3/2013 |

* cited by examiner

MANAGING ACCESS RIGHTS TO A CRANE

FIELD OF THE INVENTION

The invention relates to controlling cranes and, in particular, to authenticating (identifying) and authorising operators of cranes that are provided with an emergency stop button.

BACKGROUND OF THE INVENTION

Publication DE102009051819A1 discloses an arrangement where a crane operator carries on his wrist an RFID card (transponder), and the control unit of the crane similarly has an RFID reader. In the technology of publication DE102009051819A1, the crane controllers, that is, the user interface, are only activated when the RFID card is within range of the RFID reader. This range is said to be 20-30 cm.

Publication DE102009051819A1, however, leaves some questions open. For example, need all holders of an RFID card have equal access rights? If all holders of an RFID card have equal access rights, what are these rights: are the rights set based on the most experienced or the least experienced operator? If, on the other hand, each holder of an RFID card has individual access rights, what are these rights and how are they set? Further, what exactly will happen in case the distance between the RFID card and RFID reader increases to more than the 20-30 cm referred to? If a crane operator, for example, places sunglasses on his eyes with two hands, should the crane be stopped by emergency stop or softly?

The question also remains unanswered of how the solution set forth in publication DE 102009051819 A1 and based on an RFID card and RFID reader is installed afterwards in an existing crane and/or its control equipment.

BRIEF DESCRIPTION OF THE INVENTION

It is therefore the object of the invention to provide a solution to at least one of the aforementioned problems. The object of the invention is achieved by a system which is characterized by what is disclosed in the independent claims. The dependent claims and the detailed description below with its drawings are related to the specific embodiments of the invention.

The invention may be implemented, for example, as a system for identifying an operator in connection with a crane, said crane having a control system and a controller placed at a distance from it. The system includes an identifier reader to be placed in connection with the controller to read an operator's identifier by using a first wireless connection. The system further includes wireless communications means to set up a second wireless connection between the identifier reader and control system. The wireless communications means are adapted to send an operator's identifier or information derived from it to the control system. The wireless communications means are additionally adapted to receive information from the control system on whether the control system accepts the operator's identifier.

The benefits of the arrangement according to the invention include, for example, simple retrofitting, because the identifier reader connects to the control system of the crane. Advantageously this takes place by using a wireless connection. Thanks to the wireless connection, it suffices that the identifier reader is mechanically mounted to a suitable place, for example, in connection with the crane controller, and there is no need to carry additional wires to the control system of the crane.

BRIEF DESCRIPTION OF THE DRAWINGS

The invention will now be described in more detail by means of the preferred embodiments and with reference to the accompanying drawings, in which.

DETAILED DESCRIPTION OF THE INVENTION

Figure 1:
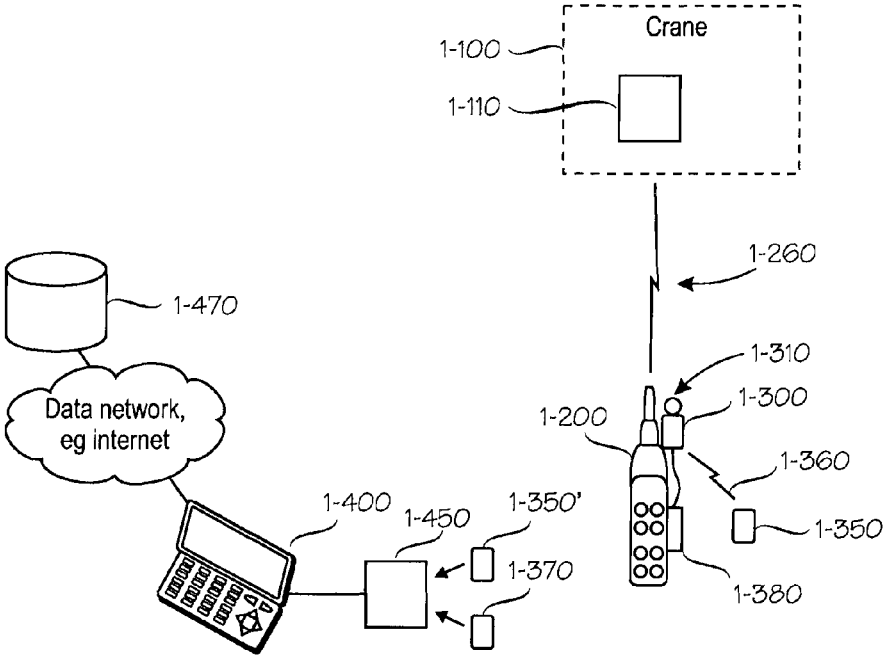
FIG. 1 shows an implementation of the invention by way of example.

FIG. 1 shows an implementation of the invention by way of example in connection with a crane 1-100. The first number in a two-part reference number, for example 1-100, indicates the figure in the context of which the element indicated by the reference number is described for the first time. If the final parts of a reference number are the same in different figures, for example 1-110 and 2-110, this refers, when possible, to the closest similar, but not necessarily identical element in the different figures. For example, the reference numbers 1-110 and 2-110 refer to the control unit ("electrical cabinet") of the crane 1-100 similarly in FIGS. 1 and 2.

Still referring to FIG. 1, the reference number 1-200 refers to the controller of the crane, that is, an input device of the user interface, used by the crane operator to give commands to the control system of the crane. Reference number 1-300 refers to an identifier reader which is or may be installed in connection with the controller and which in a typical but non-restrictive implementation is a reader of the RFID identifier. The RFID identifier may be read from an RFID chip 1-360, which in everyday language is referred to as an RFID card, although the external packaging of the chip may be of another kind. Reference number 1-360 refers to the signalling connection between the identifier reader 1-300 and identifier chip 1-350, this signalling connection in a typical but non-restrictive implementation being an RFID signalling connection, as mentioned.

Assuming that the identifier reader 1-300, chip 1-350 and the connection between them are based on the RFID technology, the elements of FIG. 1, which have been described heretofore, are identifiable by the publication DE102009051819A1. As mentioned in the preamble of this patent description, the publication DE102009051819A1 leaves certain questions open, and finding answers to these questions is the goal of this invention and its embodiments.

One unanswered question relates to retrofitting the identifier reader 1-300 in connection with the controller 1-200. Publication DE102009051819A1 apparently assumes that the controller 1-200 and identifier reader 1-300 are manufactured as one integrated piece. According to an embodiment according to this invention, the identifier reader 1-300 is delivered as an element separate from the controller

1-200, whereby the identifier reader 1-300 may be mechanically fixed to the controller 1-200 with, for example, glue, sticker, bands, cable ties, magnets, or similar.

Energy supply to the identifier reader 1-300 may be implemented, for example, by connecting the identifier reader 1-300 to the energy supply of the controller 1-200. If, in connection with retrofitting, it is not desired that a connection be made to the energy supply of the controller 1-200, the identifier reader 1-300 may operate on a battery, which may be replaced in connection with annual servicing, for example. Installing the arrangement according to the invention in an existing crane may be facilitated, if the identifier reader 1-300 connects to the control system 1-110 of the crane 1-100 wirelessly. The reference number 1-260 indicates such a wireless connection. A suitable wireless access technology is the so-called Zigbee (see, www.zigbee.org and IEEE 802.15). Zigbee is well suited for the signalling protocol of self-organizing networks. In addition, its range is not as limited as that of Bluetooth, for example.

The programming of the identifier chip or card 1-350 in this example takes place with a programming device 1-450. The reference number 1-350' refers to the identifier chip 1-350 when it is connected to the programming device 1-450. The programming device operates under control of a data processing device 1-400, which may be a conventional computer, such as a laptop computer, which communicates with a database 1-470 through a data network, such as the Internet and/or a cellular network. A typical information element programmed on the identifier chip 1-350 is the identifier of the card holder, that is, the operator of the crane.

The identifier reader 1-300 reads the identifier chip or card 1-350 and forwards the information that it read from it to the crane control system 1-110. The crane control system 1-110 may store information of the commands received by the crane and the operations the crane has carried out, whereby each command and operation may be associated with the operator of the crane at the time in question.

According to an embodiment, different operators may possess different rights to operate a crane, and these different kinds of rights may be stored on the identifier chip 1-350 in addition to the identifier of the card holder. Alternatively, only the identifier of the card holder is stored on the identifier chip 1-350, and the crane control system 1-110 may retrieve the operator's rights from a database, which may be a crane-internal database (not shown) or a centralized database 1-470. In addition, the expiry date may be stored on the identifier chip 1-350 and/or in the database.

An operator's individual rights may include, for example, a validity period, the maximum load weight and/or the right to operate near the operating limits of a crane, the right to use various kinds of loading means, a boom or the like, the right to control one of more trolleys of a crane in a tandem operation, that is, dual operation in order to lift long items, for example, and/or the right to dual operation of two cranes etc. According to an embodiment, the identifier reader 1-300 provides a positive response in the form of, for example, an audio and/or light signal once the identification and possible retrieval of rights from a database have been carried out.

Other type of information in addition to the operator's identifier and rights may be stored in the database 1-470 or another similar information structure. The database may, for example, have a "black list", in other words, a revocation list of cards the use of which is to be prevented altogether. As another example, the database may contain groups of cranes and/or other devices so that an operator's rights are the same for all the devices of the group. To take a third example, the database may have information on the pairing of the identifier reader 1-300 and the crane control system 1-110 (or its emergency stop system). In other words, a particular programming card may be used to tell the crane control or emergency stop system which identifier reader it should listen to. Instead of or in addition to these, history information on identifiers that have been used may be stored in the database, and it is possible to read from the database who was in charge of the operation of the crane at any one time. According to an option or additional feature, the database has a list of the identifiers the use of which must be entered in the history information. According to yet another option or additional feature, the database has a list of the identifiers on which an immediate notification must be given to outside of the crane control system, such as the terminal device used by the system administrator. Instead of or in addition to the above, an additional feature may be implemented wherein the identifier reader enters a mark on a read identifier chip. When the identifier chip is read in the identifier reader of the programming software, it is possible to detect that the required devices have been updated with the information.

Although it is in principle possible to set up "master keys", that is, identifier chips the users of which have all the rights according to the database, a situation may arise in connection with system testing or version management where a crane might have a new or added feature but the database did not yet have the field added in it, indicating the authorization of the corresponding action. With such a situation in mind, it is preferable if the system identifies a specific information element on the identifier chip, indicating unlimited access rights for maintenance men, for example.

A technique to program individual rights for operators is based on the master operator of a crane, who may be the maintenance manager or similar, programming the card 1-370, the so-called programming card, indicating the operators' rights, and uses this card to program the crane to suit different kinds of operator groups. The rights of individual operators may be defined by placing the operators in one or more operator groups. According to an implementation, the master operator makes the programming card 1-370 by means of the programming device 1-450 under control of the data processing device 1-400. The person responsible for hoists brings the programming card with its content in the vicinity of the reader 1-300 so that the information on the programming card may be communicated through connections 1-360 and 1-260 to the control system 2-110, 3-110. In the case of FIG. 1, the information may be conveyed through the identifier reader 1-300, for example, and, in the case of FIGS. 2 and 3, through the database 1-470 and connection 2-130. This setting up of rights may be associated with a feature where the control system 2-110, 3-110 sends back an acknowledgement after receiving the information. The acknowledgement may similarly be conveyed back to the database 1-470 and the programming device 1-450 either through the connections 1-360 and 1-260 or, alternatively, through the connection 2-130. After the rights have been defined on the control system, the acknowledgement feature ensures that the information is kept in the database 1-470 in a centralized manner. If the definition of rights were only performed through the crane operator's card, there would not necessarily be full certainty in the everyday use of the crane on the acknowledgement being returned by the operator, that is, without the person in charge of the hoists, such as the maintenance manager, the programming device 1-450, further to the data processing device 1-400 and the database 1-470 in the case of FIG. 1.

Power supply to the identifier reader 1-300 and/or sensor 1-310 is advantageously arranged by a power source 1-380. The power source is advantageously small-sized whereby it may be located in connection with the controller 1-200, for example. In new cranes, the interfacing may be carried out in such a manner that the supply voltage is obtained from within the controller 1-200. A small battery or rechargeable battery attached externally is an advantageous alternative for retrofitted cranes because there is no need then to open the controller 1-200 itself. This provides the advantage that the fairly high humidity classification of the controller 1-200 may be maintained at the original level. For the external mounting, sticker tape, cable ties, a plastic or metal band etc. may be used. The mounting may be performed so that a thin case is attached to the controller 1-200 itself, in which the identifier reader 1-200, sensor 1-310 and a potential back-up power source 1-380 may be arranged.

A question that prior art leaves open is how long the authorization read from the identifier chip 1-350 is valid at a time. The chip itself is associated with a validity period, which is typically counted in months or years. But once the operator (holder of the chip 1-350) has been identified, must the chip uninterruptedly be at a distance of 20-30 cm from the reader for the crane to work to begin with, as in prior art? Some embodiments of the invention and details for implementing it deal with this question and solutions to it. If the distance referred to is as small as 20-30 cm, as in prior art, this means in practice that the chip must be attached to the operator's wrist, as shown by the Figures of the publication. What this for its part means is that the operator cannot change the hand he uses to control the crane in the middle of the working day, not easily anyway, although this might be a welcome change from the ergonomics viewpoint.

According to an embodiment, the operator's identification from the identifier chip 1-350 is valid for a specific fixed time period at a time, for example, a few minutes or 10-15 minutes. When the fixed time period is about to run out, the identifier reader 1-300 may provide a reminder, by a sound signal, for example, that the identifier chip 1-350 needs to be briefly brought close to the reader 1-300.

According to an alternative or supplementary implementation, in connection with the controller 1-200, in the identifier reader 1-300, for example, there is a sensor 1-310, such as an acceleration or tilt sensor, which indicates the position or movement of the controller, and whose output signal shows that the identifier reader and controller are moving or that their position is changing with respect to at least one axle. The acceleration or tilt sensor may be used to indicate with at least moderate certainty that the crane has been under control of the same operator without interruptions. For example, when the output signal from the acceleration or tilt sensor corresponds to a motion that differs from the swinging of a controller 1-200 left free, it may be concluded that the controller 1-200 has been in active use by its operator. Each of such motions that deviate from free swinging may renew the time limit of operator identification. If, for example, identification is valid for 5 minutes at a time, and the latest identification took place at 2pm, the identification would expire at 2.05pm. But if at 2.03pm motion of the controller 1-200 is detected, which differs from free swinging of the controller, the validity of the identification is extended until 2.08pm. A simple way to detect whether the swinging of a controller 1-200 corresponds to the swinging of a controller 1-200 that has been left free is one where the sensor 1-310 is a tilt sensor. When the tilt exceeds a specific threshold value, it may be detected that the sensor 1-310, and hence the controller 1-200, are in active use by their user. According to an alternative implementation, the sensor 1-310 is an acceleration sensor. If the acceleration of the controller 1-200 exceeds a specific threshold value which may be, for example, 2-10% or 4-6% of free-fall acceleration, it may likewise be concluded that the controller 1-200 is in its user's active use. According to yet another implementation, if the shape of the output signal from the acceleration or tilt sensor deviates enough from a damping sine wave, it is similarly possible to conclude that the controller 1-200 is being actively used by its user. The detection of a user's activity on the basis of a position sensor requires that the controller 1-200 has a particular normal position to which it automatically returns unless it is used. In case the controller hangs supported by a wire, this usually takes place, but if the controllers are coupled wirelessly, such a normal position does not necessarily exist.

If the technology described in the above is implemented, in which the detection of a change in the movement or position of the controller brings about a continuation of the identification validity, it is also advantageous to implement a feature where the crane operator may immediately terminate the validity of a performed identification as he leaves the crane. Such a termination of identification may be implemented with a push button, for example.

Figure 2:
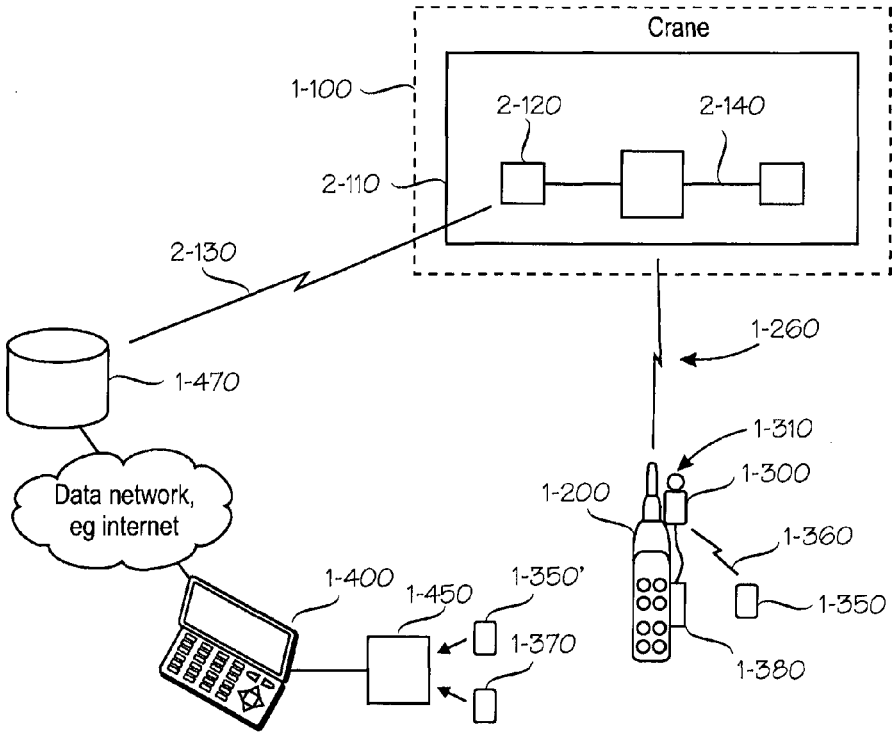
FIG. 2 shows another implementation of the invention, in which the crane control system has an online connection to a database that is centrally managed.

FIG. 2 shows another embodiment of the invention. Reference numbers of the type 1-xxx indicate elements that are described in connection with FIG. 1, so the detailed description of these elements will not be repeated. The difference with respect to the implementation of FIG. 1 is that in the implementation of FIG. 2 the crane controller 2-110 comprises a remote connection 2-120 for communication to the database 1-470. In this exemplary implementation, the remote connection 2-120 includes a wireless connection 2-130 to the database 1-470 or the database server (not separately shown). In addition, the remote connection 2-120 includes an internal connection 2-140 in the crane control system for transferring the information communicated with the database 1-470 within the crane control system 2-110. In accordance with an embodiment, such information communicated with the database 1-470 may include each operator's individual rights read from the database 1-470 whereby it is not necessary to program these individual rights on each operator's identifier chip 1-350. Alternatively, or in addition to the above, the crane control system 2-110 may send information to the database 1-470 on the operator and the crane use. At its minimum, this may denote information on which operator operated the crane at any one time. A more comprehensive implementation includes the entire operation history of the crane, with potential information on load weight, whereby the operation history will include information on who used the crane and when. According to yet another alternative or supplementary embodiment, the identifier reader 1-300 and/or the database are associated with a remotely controllable black list and blocking logic by means of which a lost identifier card, for example, may be blocked.

Figure 3:
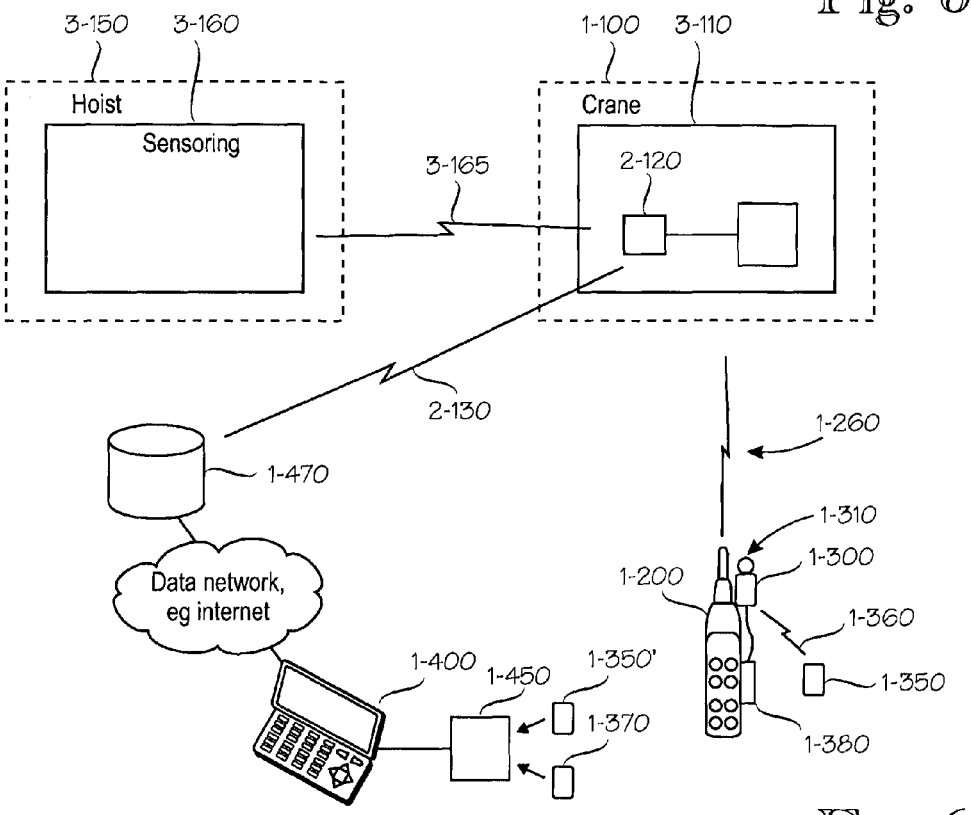
FIG. 3 shows a third embodiment of the invention, for a crane that uses intelligent sensoring for determining the load weight, for example.

FIG. 3 shows another implementation of the invention. Reference numbers of the type 1-xxx and 2-xxx indicate elements that are respectively described in connection with FIGS. 1 and 2, so the detailed description of these elements will not be repeated. The difference with respect to the implementation shown in FIGS. 1 and 2 is that the implementation of FIG. 3 is meant for a crane that uses sensoring to determine the load weight. In the example of FIG. 3, such sensors are placed in connection with the hoists 3-150 of the crane, and the sensoring is generally denoted by the reference number 3-160. Because the hoists are able to travel along the bridge of the crane, it is advantageous to use wireless signalling as the distances are changing. The crane controller 3-110 comprises a remote connection 2-120 for communication to the database 1-470. The reference number 3-165 indicates the signalling connection between the crane controller 3-110 and sensoring 3-160. The signalling connection in this example, too, may be in accordance with the Zigbee standard, for example.

Figure 6:
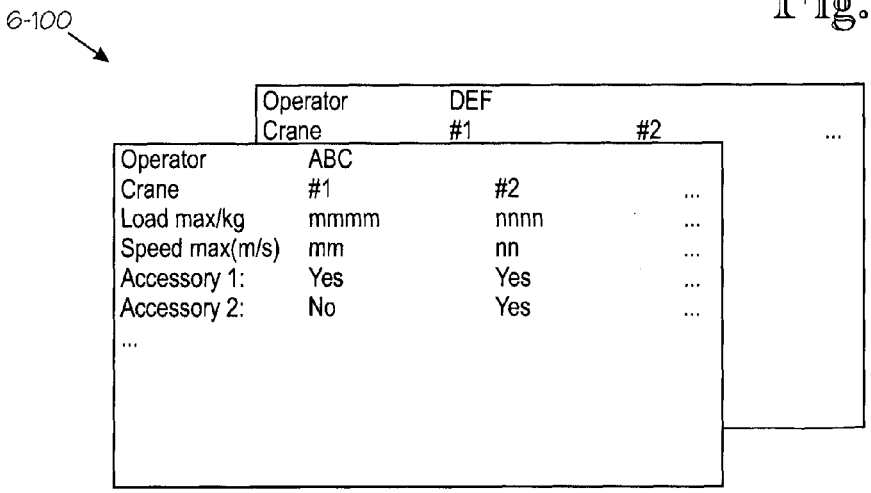
FIG. 6 is a chart of a data structure describing operator-specific parameters that define rights for an operator.

FIG. 6 shows schematically an information structure 6-100, which describes operator-specific parameters that define an operator's rights separately for each crane or group of cranes. The information structure 6-100 has a plurality of parameters assigned to an operator identifier ("ABC") for a plurality of cranes, these parameters including, for example, the maximum weight of a load, maximum driving speed, and the chance to use a plurality of accessories. The parameters of the information structure 6-100 may be communicated to the crane control system 1-110, 2-110, 3-110 in various ways.

In such a case it is advantageous, if the decision on whether the action requested by the operator is permissible, that is, within the operator's scope of rights, is made by the crane control system 1-110, 2-110, 3-110 instead of the manual controller 1-200 or identifier reader 1-300 located in connection with it. It is additionally advantageous that when an operator's rights are changed, the changes can be performed without making changes in the crane control system 1-110, 2-110, 3-110.

A technology, suitable for use in the embodiment of FIG. 1, is to store the parameters defining operator rights on the identifier chip 1-350 by the programming device 1-450 under control by the data processing device 1-400. The parameters may be read for the information of the control system 1-110 by the identifier reader 1-300 through connections 1-360 and 1-260.

Another technology that is suited for use in the embodiments of FIGS. 2 and 3 is to store the parameters defining operator rights in the database 1-470 from which the control system 2-110, 3-110 retrieves them through the connection 2-130 on the basis of the operator's identifier. The control system 2-110, 3-110 acquires the operator's identifier from the identifier reader 1-300 through connections 1-360 and 1-260.

Figure 4:
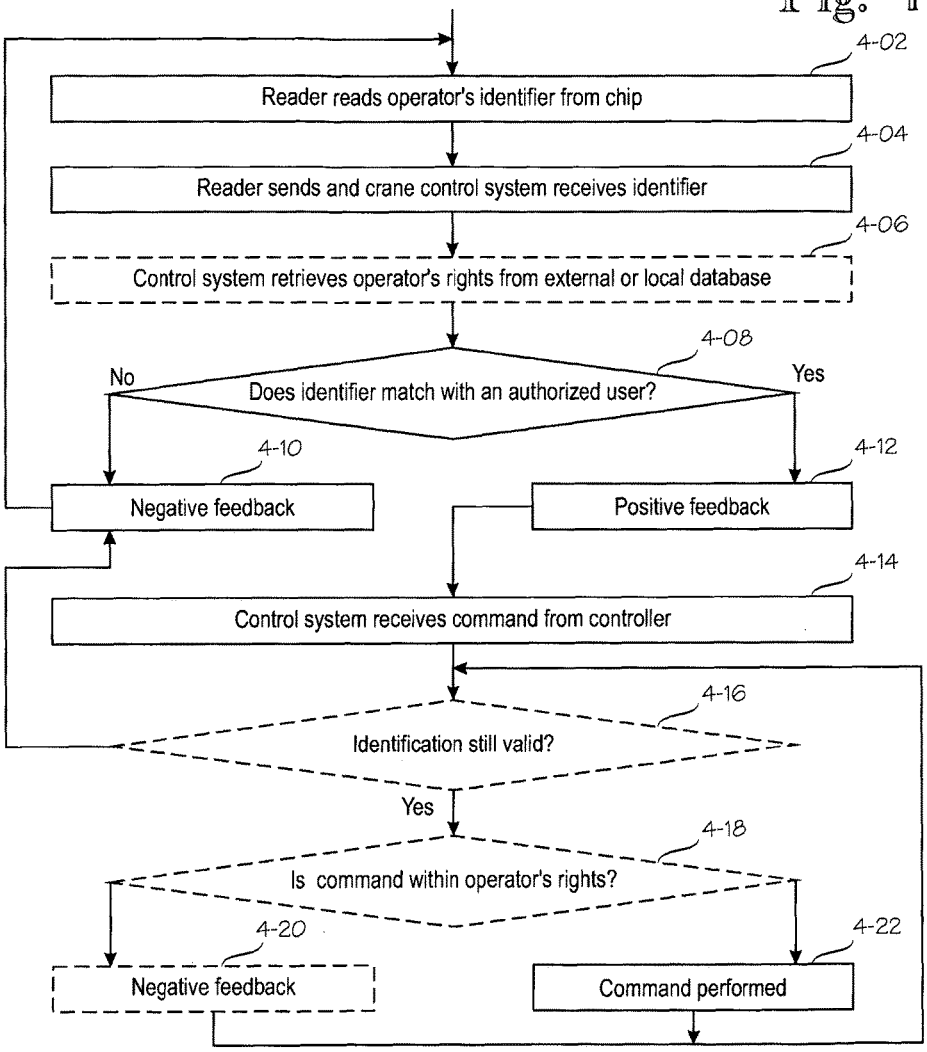
FIG. 4 shows a flowchart illustrating some of the embodiments of the invention.

Referring next to the flow chart of FIG. 4, the embodiments shown in FIGS. 1-3 may function as follows, for example:

At step 4-02, the reader 1-300 reads the operator's identifier from the chip 1-350 through the connection 1-360. At step 4-04, the reader 1-300 sends and the crane control system 1-110, 2-110, 3-110 receives the identifier through the connection 1-360. At step 4-06, the crane control system retrieves the operator's rights based on the identifier from the database 1-470 through the connection 2-130. Alternatively or in addition to this, the crane control system may obtain the operator's rights from the chip 1-350 with the identifier reader 1-300. Furthermore, the crane control system may store or cache operators' rights locally. At step 4-08, the crane control system examines whether the identifier read from the chip 1-350 matches with an authorized operator. If the identifier does not match with an authorized operator, a negative response (sound and/or light signal) is given to the operator at step 4-10. If, based on information read from the database 1-470, the identifier matches with an authorized operator, a positive response is given to the operator at step 4-12.

What has been described up until now is common for the embodiments of FIGS. 1-3, except that in the embodiment of FIG. 1 where the crane control system 1-110 has no online connection to the database 1-470, the crane controller 1-110 needs to evaluate an operator's authorization locally. To simplify this task, it may be assumed, for example, that the chip 1-350 contains the operator's identifier and possible validity period, only. If the validity period has not expired, the implementation of the control system may assume that the operator is entitled to operate the crane in every feasible way.

According to an optional feature, the control system makes sure at step 4-16 that the performed identification is still valid. As set forth in the above, it is advantageous due to ergonomics, for example, that the chip identifier need not be uninterruptedly within the reading distance of the reader 1-300, but that the performed identification may be valid for a particular time period at a time, such as a few minutes. An implementation of such a process is described in greater detail in connection with FIG. 5.

The crane control system 2-110, 3-110 in the embodiments of FIGS. 2 and 3 may make use of an online connection 2-130 to the database 1-470, which allows the operator's rights to be managed in a centralized, diverse, and/or detailed manner. The crane control system may consequently, at step 4-14, receive a single command from the controller 1-200 and at step 4-18 compare the command to the operator rights read from the database 1-470. If the command received from the controller 1-200 is not within the scope of the operator's rights, the control system provides a negative response to the operator at step 4-20. Such a situation may arise when, for example, the control system detects, based on the sensors 3-160, that the load is too heavy with respect to the operator's rights, or loading means are in use for which the current operator has not received training. If the command received from the controller 1-200 is within the scope of the operator's rights, the crane control system carries out the command at step 4-22.

Figure 5:
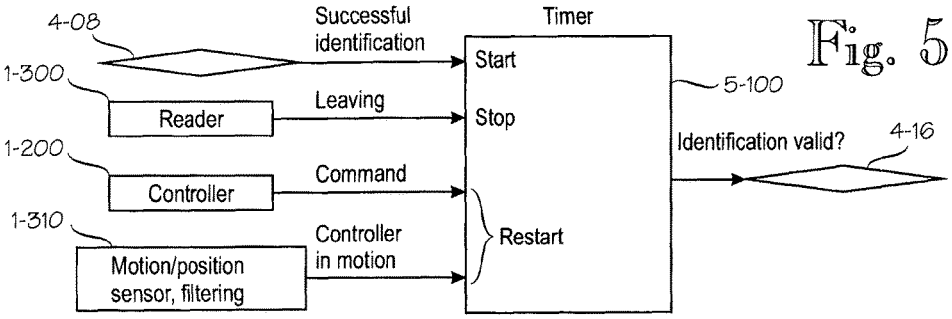
FIG. 5 shows a timer by means of which an approved identification of an operator may be kept valid for a fixed period of time, even if the user's identifier were not continuously at the reading distance of an identifier reader.

FIG. 5 illustrates an implementation where the performed identification is valid for a specific time period at a time, and this time period begins anew when the motion detector in connection with the crane controller indicates that the controller has been continuously used by the same operator. Such an implementation is illustrated by the flow chart of FIG. 5, even though the practical implementation may in many cases be programmatic.

The reference number 5-100 denotes a timer, the output signal of which shows that a successfully performed operator identification is still effective. The timer resets after a particular time period, whereby the timer output signal indicates that the identification is no longer valid. This time period may be a few minutes, for example. The timer 5-100 is activated by, for example, a successful completion (the "yes" branch) of step 4-08 in FIG. 4. The timer may be returned to the normal state whereby the identification is no longer valid by an exit button, which is installed, for example, in connection with the reader 1-300, and which an operator may use to indicate he stops operating the crane. Alternatively, an operator may notify the crane control system of stopping to operate the crane by using a button, such as the emergency stop button, on the crane controller 1-200, if the crane controller 1-200 has such a button. The time period of the timer will start running anew, if the operator controls the crane by the buttons on the controller 1-200 or other input means. Alternatively or in addition to this, a sensor, such as an acceleration and/or tilt sensor mounted in connection with the controller 1-200, may indicate that the controller has been under control by the same operator almost without interruptions. That is to say that when a controller is left to swing freely by its connecting cable, it settles to swing in a manner depending on the mass and the length and rigidity of the cable, although the swinging is not necessarily mathematically simple or taking place in one plane. A movement significantly deviating from this free swinging, such as a spectre that differs from the normal of acceleration, or a high instantaneous value, or a tilt exceeding a specific threshold value, shows that the controller has moved with the hand of its operator, and each of such movements makes the time period of the timer start anew.

It is apparent to a person skilled in the art that as technology advances, the basic idea of the invention may be implemented in many different ways. The invention and its embodiments are thus not restricted to the examples described above but may vary within the scope of the claims.

The invention claimed is:

1. A system for identification and access rights management of an operator in connection with a crane, the crane having a control system and a controller positioned remotely from it, wherein the control system is adapted to maintain a plurality of operator-specific parameters that define rights of a current operator, and the system comprises:

an identifier reader placed in connection with the controller and configured to read the operator's identifier by using a first connection; and communications means configured to establish a second connection between the identifier reader and the control system, wherein the communications means are configured to transmit the operator's identifier or information derived from it to the control system, the control system is configured to receive a single command from the controller, and to compare operations requested through the controller in said single command with said plurality of operator-specific parameters, which define the rights for the current operator, and to allow the operation of the crane only when said single command is within a scope of rights associated with the operator's identifier, wherein the rights defined for the current operator include two or more of: a right to use one or more accessories, a right to control one of more trolleys of a crane in dual operation, a right to dual operation of two cranes, maximum driving speed and a maximum limit for a weight of a load, wherein the control system is further configured to:

add at least one new feature of the crane via communication with a programming card and the identifier reader when the identifier reader confirms an operator's identifier is a master key, the master key providing access to all rights to the crane, and update the rights of all operators according to the programming key with respect to the at least one new feature.

2. The system as claimed in claim 1, wherein the first connection between the identifier and identifier reader is a wireless connection.

3. The system as claimed in claim 1, wherein the second connection between the identifier reader and the control system is a wireless connection.

4. The system as claimed in claim 1, wherein the system is adapted to maintain valid the acceptance of an operator's identifier for a predetermined time period even when the operator's identifier is no longer within the reading range of the identifier reader.

5. The system as claimed in claim 4, wherein the system is adapted to start the passing of the predetermined time anew in response to the use of the controller.

6. The system as claimed in claim 4, wherein the system additionally includes a motion and/or position sensor moving with the controller, and the system is adapted to start the passing of the predetermined time anew in response to the output signal of said motion and/or position sensor.

7. The system as claimed in claim 1, wherein the system additionally includes a user interface element for immediate termination of the acceptance of an operator's identifier.

8. The system as claimed in claim 7, wherein the user interface element for immediate termination of the acceptance of an operator's identifier is an emergency stop button of the crane.

9. The system as claimed in claim 1, wherein the control system is adapted to receive said operator-specific parameters, which define the rights of each particular operator, from the identifier reader.

10. The system as claimed in claim 1, wherein:

the system additionally includes a database which is adapted to receive said operator-specific parameters, which define the rights of each particular operator; and the control system is adapted to retrieve said operator-specific parameters from the database.

11. The system as claimed in claim 1, wherein the right to use one or more accessories includes a right to use one or more loading means and/or a right to use a boom.

* * * * *